US005755175A

United States Patent [19]

White et al.

[11] Patent Number: 5,755,175

[45] Date of Patent: May 26, 1998

[54] VISIBLE SEAL FOR CONTAINERS

[75] Inventors: Robert W. White, Franklin Lakes, N.J.; David J. Haas, Suffern, N.Y.

[73] Assignee: Temtec, Inc., Suffern, N.Y.

[21] Appl. No.: 729,063

[22] Filed: Oct. 10, 1996

Related U.S. Application Data

[60] Provisional application No. 60/005,229, Oct. 10, 1995.

[51] Int. Cl. [6] ..... B65O 27/30

[52] U.S. Cl. ..... 116/206; 116/200; 292/307 R

[58] Field of Search ..... 116/278, 200, 116/206, 212, DIG. 34; 292/307 R, DIG. 32, 288; 24/704.1; 70/57.1, 416

[56] References Cited

U.S. PATENT DOCUMENTS

| | | | |
|---|---|---|---|
| 3,441,304 | 4/1969 | Chidley et al. | 116/206 |
| 3,463,532 | 8/1969 | Chidley et al. | 116/206 |
| 4,118,057 | 10/1978 | Ryan | 292/307 R |
| 4,793,644 | 12/1988 | Swift | 292/307 R |
| 5,289,929 | 3/1994 | Heilman et al. | 215/230 |
| 5,323,729 | 6/1994 | Rubey | 116/200 |
| 5,587,703 | 12/1996 | Dumont | 70/57.1 |

*Primary Examiner*—Thomas B. Will
*Assistant Examiner*—Andrew Hirshfeld
*Attorney, Agent, or Firm*—Michael Zall

[57] ABSTRACT

A tape seal for containers is provided. The tape seal comprises a strap mountable to locking bars of a shipping container, a tensioning device connected to the strap for applying tension to the straps after the straps are mounted to the locking bars, and an indicator affixed to the strap. The indicator has a first indicia coacting with the strap for indicating that the strap is at an initial tension and the container is secured. The indicator also has a second indicia also coacting with the strap for indicating that the strap is at a second tension less than the initial tension after the initial tension has been applied. The first indicia indicates that the strap is securely mounted to the locking bars and the second indicia indicates that the strap is not securely mounted to the locking bars thus indicating that there may have been tampering with the seal.

4 Claims, 12 Drawing Sheets

VISIBLE SEAL FOR CONTAINERS

SPECIFICATION

BACKGROUND OF THE INVENTION

RELATED APPLICATIONS

This application is related to the provisional application U.S. Ser. No. 60/005,229, filed Oct. 10, 1995.

FIELD OF THE INVENTION

The present invention relates to seals to secure shipping containers and the like, and particularly relates to seals which display an altered indicia visible from a distance when they have been tampered with or have been breached.

DESCRIPTION OF THE PRIOR ART

Containerization, the concept of filling a container having standardized dimensions with articles and then sealing the container for transport aboard ships and other intermodal systems, has revolutionized the shipment of products. However, with thousands of containers moving in and out of ports daily, the task of monitoring these containers, both on ships, trains, trucks or at the terminals, is very difficult. One of the difficulties is determining whether there has been tampering with any of the numerous containers. It is thus important to be able to rapidly and effectively determine from a distance if there is tampering or pilferage of any of the numerous containers. Such rapid detection of tampering or pilferage is necessary as a deterrent and for submitting insurance claims.

Different devices and methods to indicate when a container has been tampered with, or breached, are known and include:

U.S. Pat. No. 3,463,532 Chidley, et al.

U.S. Pat. No. 4,557,505 Schaefer, et al.

U.S. Pat. No. 5,108,803 Kondo, et al.

U.S. Pat. No. 5,289,929 Heilman, et al.

U.S. Pat. No. 5,323,729 Ruby

U.S. Pat. No. 3,463,532 to Chidley, et al. discloses a security seal used with a shipping container which consists of an elongated band to encircle handles between the door and the container. The band ends are connected to each other by adhesion. A weakened seam is furnished along the band by heat sealing a lap joint. The adhesion of the surfaces of the band ends is of a magnitude that ensures the rupture of the lap joint before the band end surfaces separate so that the rupture of the lap joint proceeds breakage of the seal. A gauze impregnated with methylene white is disposed in the band so that upon rupture of the joint the methylene white is exposed to the air to turn blue and to signal a breach in security. The band can have printed thereon an indicia such as a seal number, name of shipper or consignee, patent number or the like. An alternative embodiment employs at least one reservoir disposed in the band in which gauze is provided to bring about the color change when the gauze is exposed to the air.

U.S. Pat. No. 4,557,505 to Schaefer, et al. discloses a stress, opacifying tamper indicating tape which indicates when a container, such as a can lid, has been opened. The tape consists of a layer that when creased, rolled or stretched, is opacified in the stretched area to obliterate the exterior viewable indicia "sealed" as an underlying layer supporting the indicia becomes opaque. Concurrently, another indicia showing the word "open" becomes clearly visible against the background formed by the whitening of the opacifying layer.

U.S. Pat. No. 5,108,803 to Kondo, et al. discloses a thermally shrinkable film having a liquid detecting function. A package is also provided that consists of a container or other item which thermoshrinkably packages the container to permit observation of integrity or injury in the container. A thermoshrinkable film having a liquid detecting function has an ink code printed thereon. The ink turns a different color or dissolves and flows away upon contact with a liquid leaking from the object contained or entering into the shrinked film. The shrinkable film may include a multi-layer film having a resinous layer with a gas barrier laminate as a middle layer.

U.S. Pat. No. 5,289,929 to Heilman, et al. discloses a tamper indicating means for vacuum closures which consists of an end panel overlying a container and which is configured to define a central button surrounded by an annular hinge portion. A vacuum in the container draws the button downwardly by a hinging action of the annular portion. A sponge is disposed on the upper surface of the button and is filled with a color dye. A cover over the button is provided with a disk disposed to face the sponge. When the vacuum is no longer present, the button snaps upwardly under the reaction of the panel hinge to engage the absorbent material layer so that the colored dye enters the layer to define indicia, such as the word "open".

U.S. Pat. No. 5,323,729 to Ruby discloses a crush indicating device that consists of a transparent cover, a compressible wall, a base and a liquid absorbent porous pad located adjacent to the base within the wall. A wick adhered to the cover sheet within the wall is spaced apart from the porous pad by a gap when the wall is uncompressed. The indicating liquid is of a contrasting color relative to the wick. When a force exceeding a given limit compresses the wall, the gap collapses placing the indicating wick in contact with the porous pad so that some of the indicating liquid transfers from the pad to the wick causing the wick to change color. The indicating wick is viewable through the transparent cover and the color change indicates that excessive force has been applied to the indicator.

None of the foregoing container seal devices is similar in structure or function to the container seal of this invention.

OBJECTS AND SUMMARY OF THE INVENTION

It is an object of this invention to provide a security seal for containers which is activated or "armed" when secured to the container doors.

It is another object of this invention to provide a security seal for containers that improves container integrity verification and seal number reading.

It is yet another object of this invention to provide a security seal that is easy to manipulate and mount to container door locking bars and that will self destruct when there is tampering or an attempted breach of the container seal.

It is still another object of this invention to provide a security seal for a container that is highly visible so that the identification of the container and/or security seal can be easily read from a distance.

It is still another object of this invention to provide a security seal for container locking bars that resists degradation from the harsh environment of terminals, aboard ship or during loading and discharge of the container.

It is a further object of this invention to provide a security seal for a container that displays the seal integrity at a substantial distance from the viewer.

It is yet a further object of this invention to provide a security seal for a container that self destructs after use and is difficult to counterfeit or reuse.

It is another object of this invention to provide a security seal that will rapidly change colors to indicate a breach or tampering.

It is still another object of this invention to provide a security seal that includes identification numbers and/or a bar code that are destroyed when the security seal has been tampered with.

All of the foregoing objects are achieved by the seal of this invention. The seal comprises a strap means mountable to locking bars of, for example, a shipping container, a tensioning means connected to the strap means for applying tension to the straps after the straps are mounted to the locking bars, and an indicator means affixed to the strap means. The indicator means has a first indicia means coacting with the strap means for indicating that the strap means is at an initial tension and the container is secured. The indicator means also has a second indicia means also coacting with the strap means for indicating that the strap means is at a second tension less than the initial tension after the initial tension has been applied. The first indicia indicates that the strap means is securely mounted to the locking bars and the second indicia indicates that the strap means is not securely mounted to the locking bars thus indicating that there may have been tampering with the seal.

The security seal of this invention can be immediately activated or "armed". The device is activated by securing it about the container door locking bars. Any tampering with the doors subsequent to securement of the seal will trigger the seal to immediately indicate tampering by a visual signal, e.g. bright colored indicia. In terminal areas, or aboard ship, such indicia is advantageous because a large number of containers can be visually scanned for any seal displaying a bright colored indicia indicating that there has been tampering with the seal.

The security seal of this invention is constructed to withstand the harsh elements in both shipping terminals and aboard ship and constructed so that the colored indicia will not unintentionally be displayed.

In addition, the security seal of this invention will self-destruct if the seal is tampered with, thus preventing reuse and/or counterfeiting of such seals.

BRIEF DESCRIPTION OF THE DRAWINGS

For a more complete understanding of this invention, reference may be had to the following description of exemplary embodiments of this invention considered in connection with the accompanying drawings, of which.

DETAILED DESCRIPTION OF THE INVENTION

As used herein the security seal of this invention will be referred to as the "Visible Security Seal". This in no way however, is meant to limit and/or restrict the scope of this invention, the elements thereof or the coaction between the elements.

Figure 1:
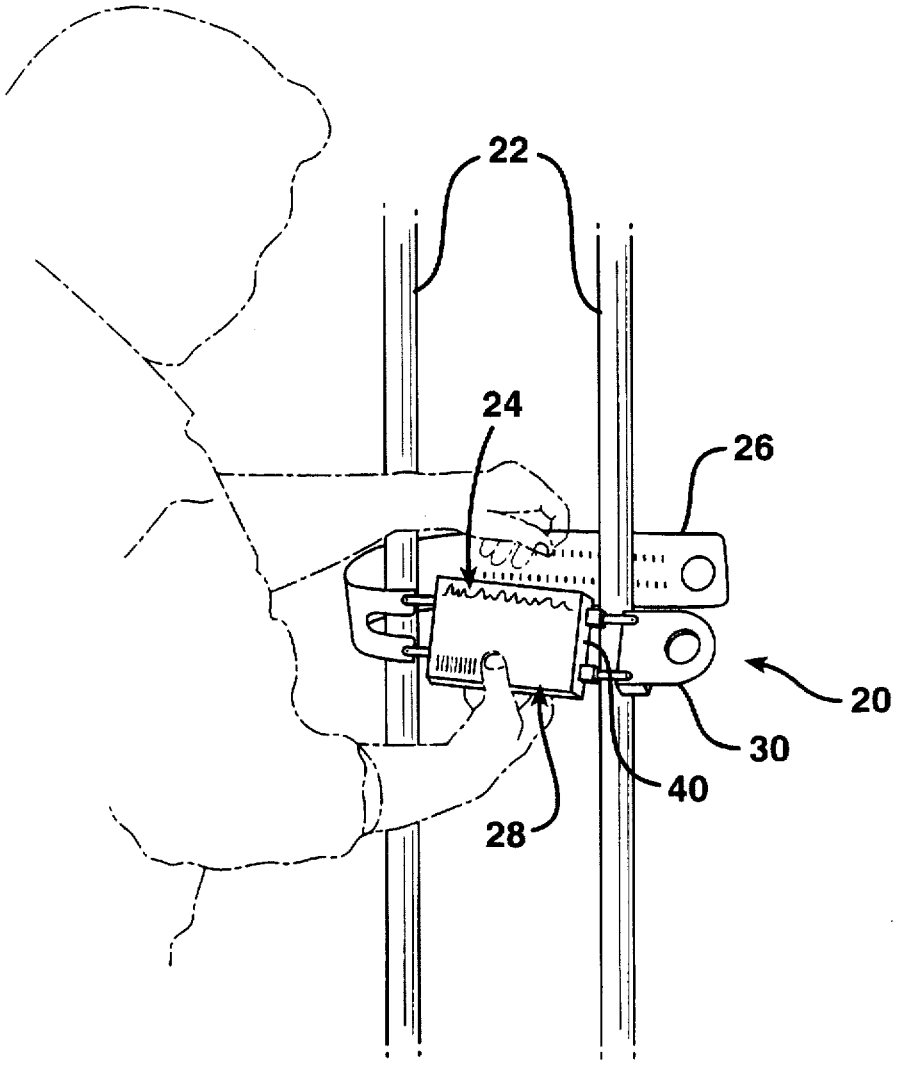
FIGS. 1–4 show one embodiment of the visible security seal of this invention being mounted to locking bars of a container.
Figure 2:
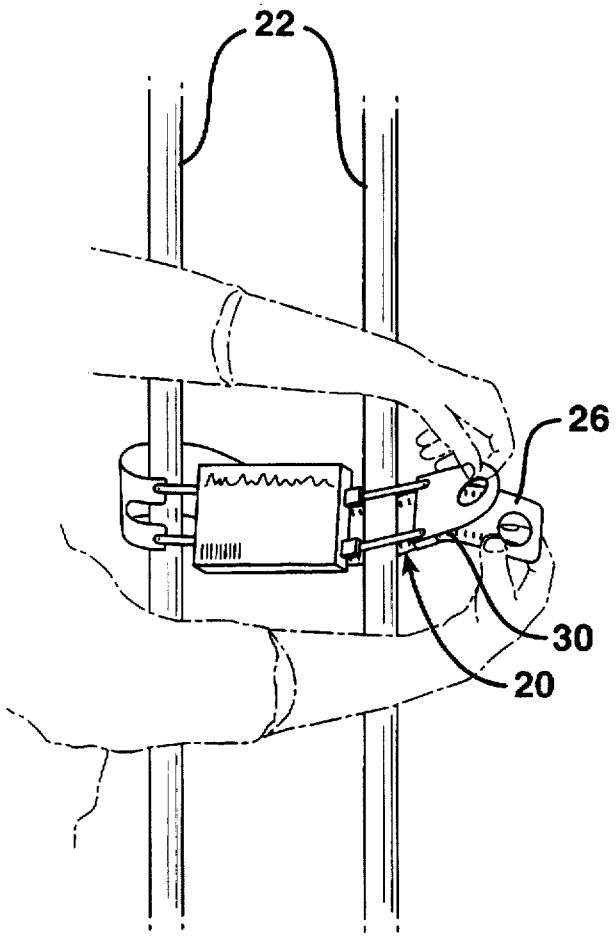
Figure 3:
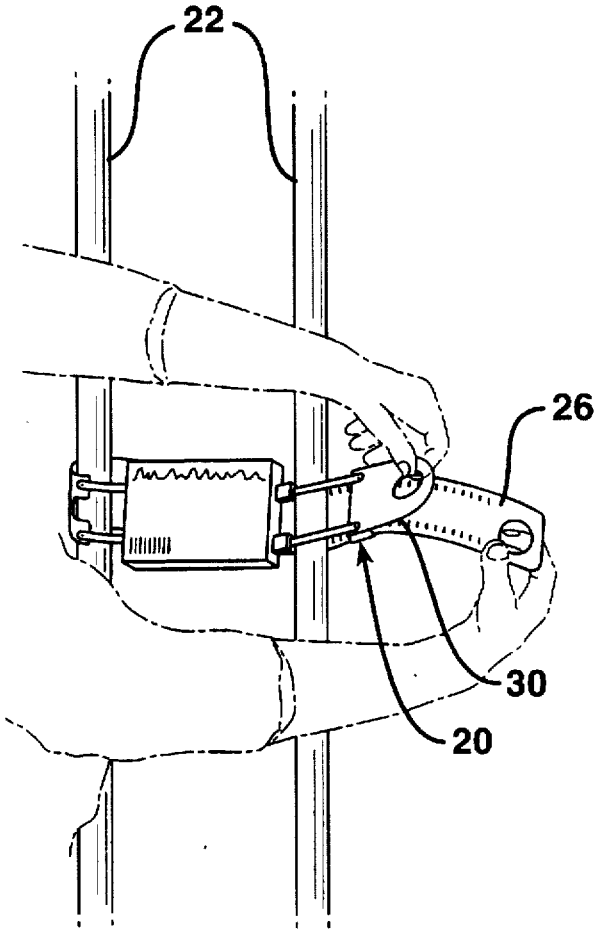
Figure 4:
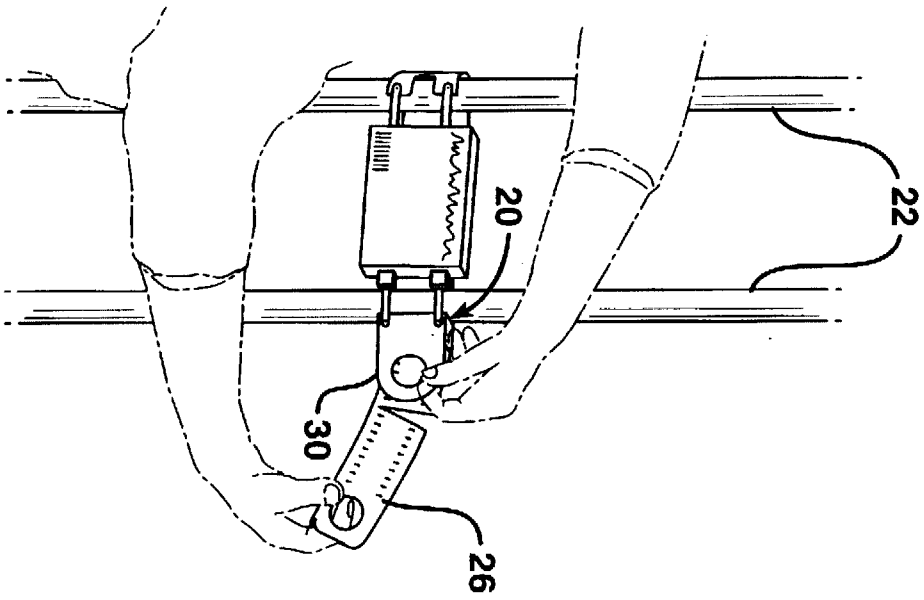

Referring for example, to the FIG. 1, the purpose of the visible security seal 20 is to improve shipping container security by enabling shipping personnel to quickly identify breaches of container security. The visible security seal 20 is an integrity seal or, if you will, a security flag to clearly show that the container locking bars 22 and/or doors have not been tampered with or opened.

For example, the visible security seal 20 has a display unit 24 having a display panel 28 that is white to indicate a non-breach condition and a color, preferably red or orange, to indicate a security breach. The visible security seal 20 provides a high degree of assurance and is difficult to defeat, requiring special skills and materials.

The visible security seal 20 is disposable. Referring to FIGS. 1–5, a preferred construction of the visible security seal 20 consists of a 4 inch by 6 inch display unit 24 mounted to an attachment strap 26 that wraps around the locking bars 22 of a container. If the display unit 24, its display panel 28 or the attachment strap 26 is cut, severed, or removed in any way that releases tension from the strap 26, the display panel 28 of the seal 20 will show a color change from, for example, white to red. Upon the container reaching its destination, the seal 20 is removed by cutting the strap 26 causing the face 28 to turn, for example, to a bright red color and for the seal 20 to self destruct. This effectively prevents any reuse of the seal 20.

Figure 5:
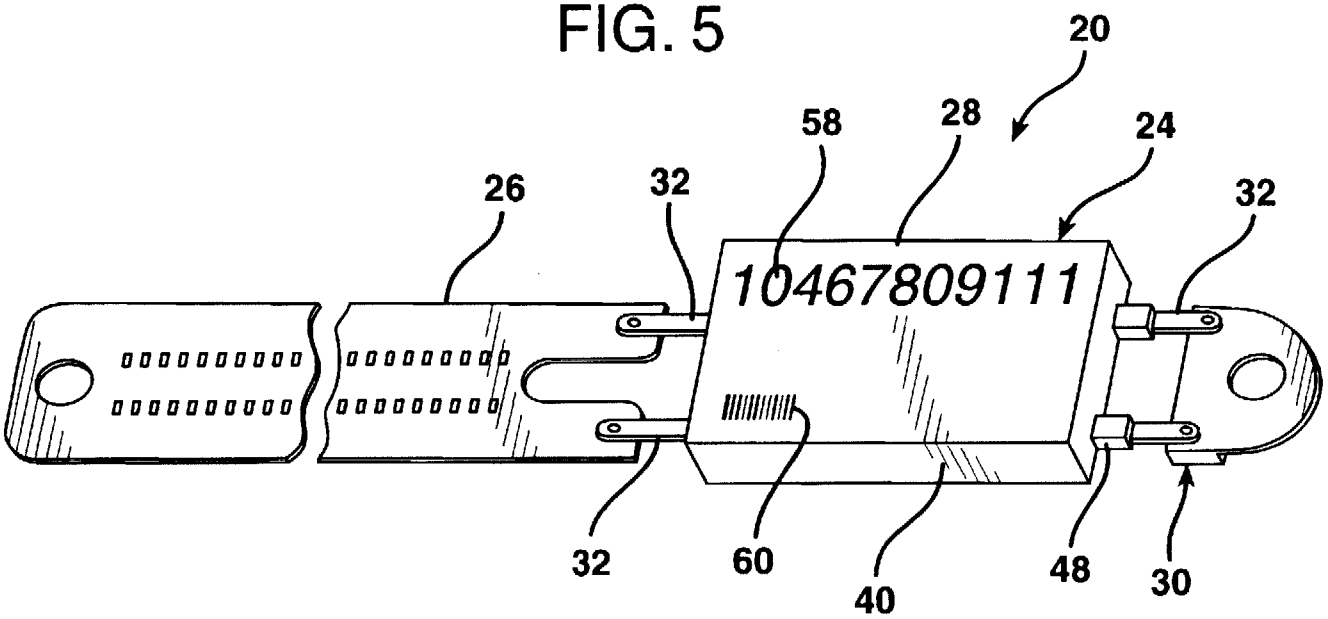
FIG. 5 is a perspective view of the embodiment of the visible security seal shown in FIGS. 1–4.
Figure 6:
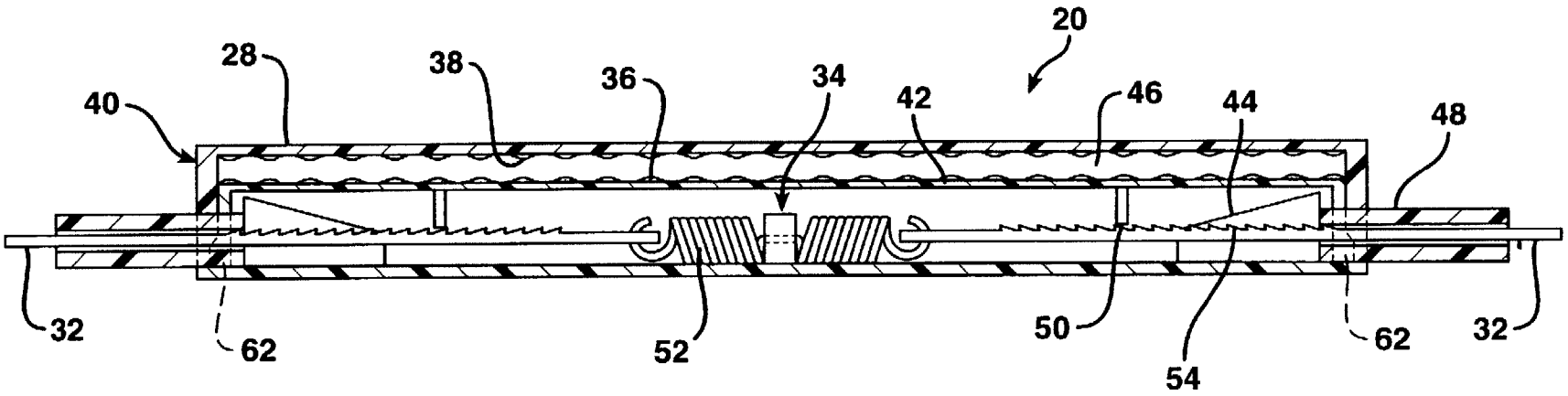
FIG. 6 is a cross-sectional view of the visible security seal of FIGS. 1–5 showing the visible security seal in an inactivated, i.e., "unarmed", status.
Figure 9:
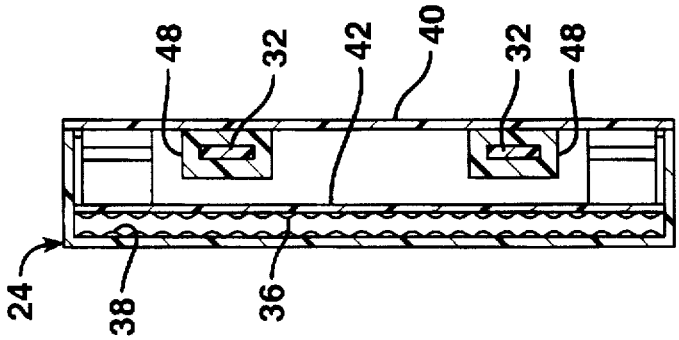
FIGS. 7–9 are various views of the visible security seal of FIG. 1–6, showing the elements therein.
Figure 7:
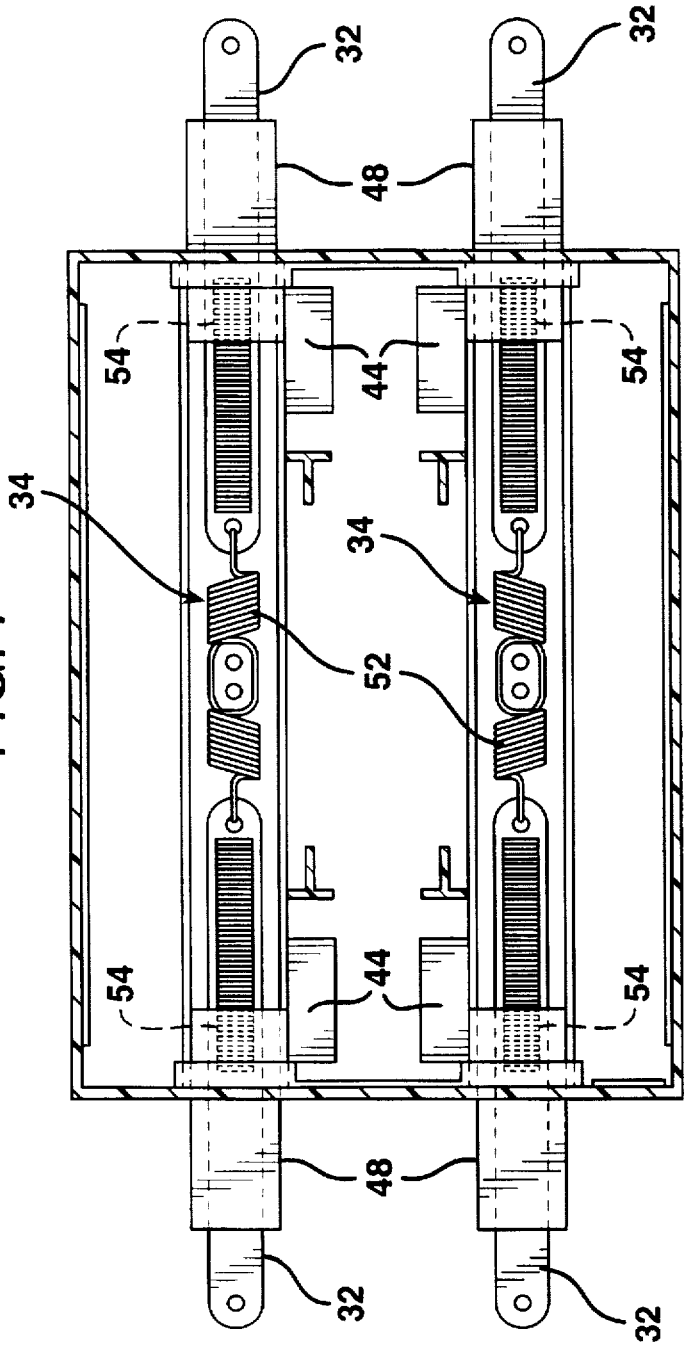
Figure 8:
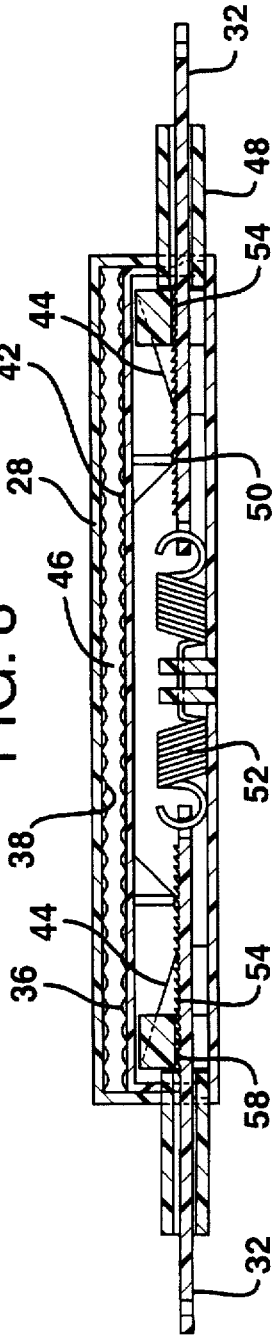

Referring to FIGS. 5 and 6, the visible security seal 20 includes three components, an attachment strap 26, a one-way buckle 30, and a display panel/unit 24. Referring to FIGS. 1–4, the seal 20 is attached to the locking bars 22 by wrapping the attachment strap 26 around the locking bars 22 of the container and engaging it through the one-way buckle 30. When both ends of the attachment strap 26 are pulled to install it around the locking bars 22, spring tension is applied to the attachment strap 26 to position and keep it from sliding or moving along the locking bars 22. Referring to FIG. 6, when this occurs the activator arms 32 of the security seal 20 are activated so that if the seal is tampered with it will release the arms 32 and cause the display panel 28 to change color to alert personnel that the container doors have been tampered with or opened.

Referring to FIGS. 6–11, the seal 20 when installed is spring loaded and held by a sensitive trip mechanism 34. When the trip mechanism 34 is released, a dye pattern or layer 36 is pushed into contact with a white adhesive coating or layer 38 that shows the colored dye pattern on the display panel 28 in a matter of hours. The dye components can also be constructed and arranged to show an immediate color change if desired.

Referring to FIGS. 6–10, the display unit 24, (with the display panel 28) consists of a brittle, sealed enclosure or housing 40 made from a high impact polystyrene, an activator plate 42, and a slide mechanism that includes four (4) activator arms 32 to which the straps 26 are attached, and four (4) activator wedges 44. In the inactivated (FIG. 6) and the activated ("armed") (FIG. 10) stages, a space ("air gap") 46 is provided between the display panel 28 and the activator plate 42.

Referring to FIG. 6, a security sleeve or bushing 48 surrounds each one of the activator arms 32 and will itself retract into the housing 40 to move the activator wedge 44 against the wedge contact point 50 for forcing the activator plate 42 against the adhesive 38 on the interior of the display panel 28. The bushing 48 will retract to cause an alert stage even if the corresponding activator arm 32 is restrained from retracting into the housing 40.

Figure 10:
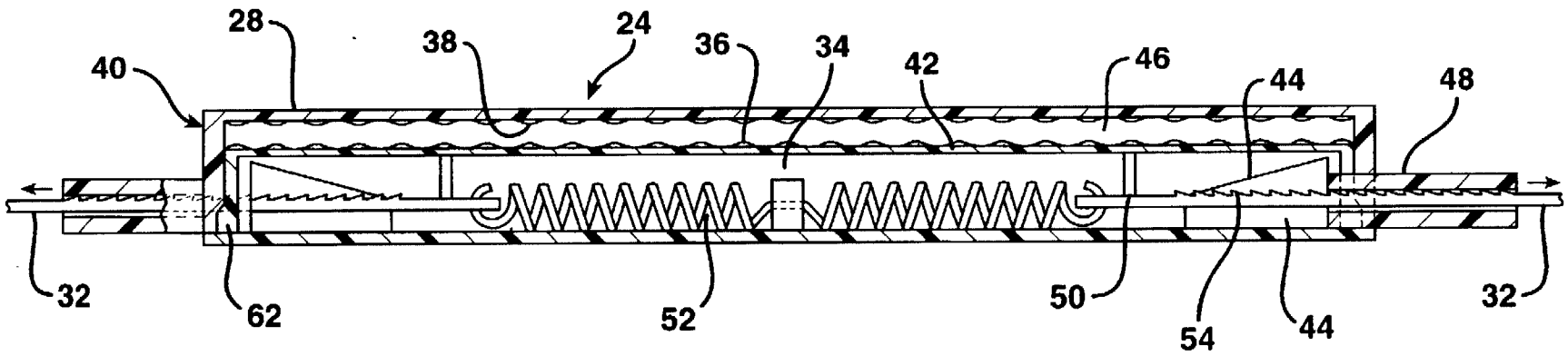
FIG. 10 is a cross-sectional view of the visible security seal of FIGS. 1–9 in the process of being activated or "armed"

Upon attaching the visible security seal 20 to the locking bars 22 of the container and pulling the attachment strap 26 tight, the activating arms 32 are extended from the display unit 24, thereby elongating the tension springs 52 inside of the housing 40 as well as ratcheting the one-way teeth or ratchets 54 on the activating arms 32 through the activator wedges 44, see, for example, FIG. 10. Each activating arm 32 is moved to the maximum extended position and the corresponding activator wedge 44 becomes firmly secure at the end of each activating arm 32. Each activating arm 32 is then under full tension from the spring 52 that applies, for example, approximately 15 pounds of force, on each arm 32 pulling it toward the center of the housing 40.

Upon tampering with the strap 26, e.g., releasing the tension on the arms 32, the spring 52 force pulls the activating arms 32 toward the center along with the wedge 44 that is securely attached thereto by the ratchet mechanism 54. Upon the inward movement of the wedge 44 under the corresponding wedge contact point 50 of the activator plate 42, the plate 42 is forced upward into contact with the display panel 24 of the security seal 20. Upon contact of the activator plate 42 with the display panel 28, the "alert" dye 36 is brought into contact with the white adhesive 38 to bleed through the adhesive 38 and display the color and/or other indicia to indicate that the security seal 20 has been tampered with.

A ratchet system 54 that can be employed in association with the activator wedge 44 is the type similar to that used on cable ties for securing bundles of cables. See for example, U.S. Pat. Nos. 3,900,922, 3,924,299 and 4,009,509, all to McCormick. The disclosures of all of these patents are incorporated herein by reference.

There are several unique features of the device of this invention. In particular, there is no spring tension in the security seal 20 during storage. This provides a long shelf-life and eliminates problems of plastic creep, heat expansion and softening of plastic parts, and accidental activation of the unit 24 should it be dropped or jarred before installation. In particular, the sealed housing 40 of the display unit 24 will provide substantial tamper resistance before and after activation.

Additionally, the entire security seal 20 is made of a minimum number of parts, e.g., 17 parts for the preferred embodiment, and only one part need move after the seal 20 is armed to activate the alert condition. The number of parts can be further decreased with appropriate design. The seal 20 can also contain relatively long lasting parts, the adhesive 38 being the most short lived element. The adhesive 38 can be designed to maintain its integrity for several years.

In order to provide enhanced tamper resistance, the security seal 20 of this invention may include a display unit 24 that is encased in a sealed, brittle, plastic unit that will fracture easily if drilled or cut. Additionally, a plurality, e.g., four activating arms 32, may be provided, each being under strong spring 52 tension. Such a plurality of activating arms 32 presents an imposing task to defeat.

In the preferred embodiment, once the display panel 24 has changed color, the dye cannot be removed, reversed or washed away and any attack on the display panel 28 and activation mechanism 34 will be immediately apparent to an observer.

The housing unit 40 is preferably formed with a "contact transparency" material so that the internal elements of the visible security seal 20 cannot be observed. When the activator plate 42 is moved into "contact" with the display panel 28 with the red/orange dye 36, the actual contact of these elements with the contact transparency material of the housing 40 will be viewable through the material so that the material appears transparent.

Figure 11:
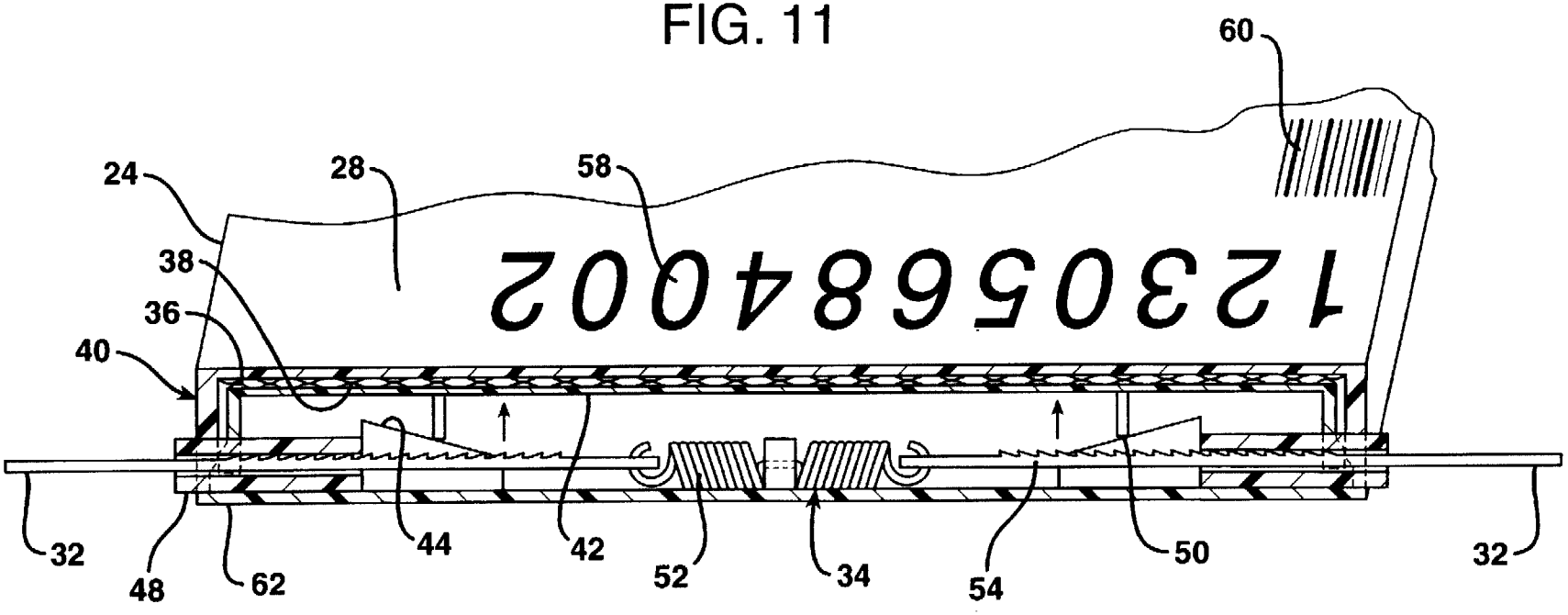
FIG. 11 is a partial perspective cross-sectional view of the visible security seal of FIGS. 1–10 in the process of activation, after a breach of the visible security seal, to display a visible alert.
Figure 15:
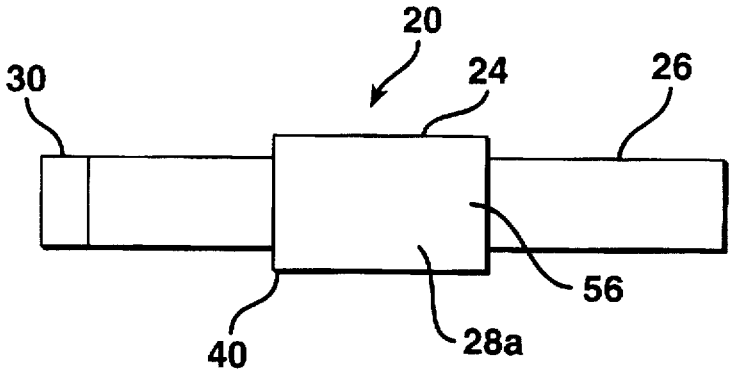
FIG. 15 is an elevational view of still another embodiment of the visible security seal of this invention.

Referring to FIG. 15, the security seal 20 is generally flat and packaged in a sealed clear plastic bag (1–2 mil polyethylene, about 8 inches×15 inches) prior to use. The seal 20 will withstand submersion in water, e.g. fresh, brackish or salt water; maximum 120° F. temperatures for one month and minimum −10° F. temperatures for one month; and a minimum shelf-life of one year. Referring to FIG. 11, the security seal 20 display unit 24 has thereon an identification number 58 and bar code 60 on it.

Referring to FIGS. 1–5, in order to install the seal 20, the seal 20 is removed from the plastic bag in which it is sealed. With the display panel 28 facing forward, the straps 26 are passed behind the locking bars 22 of the container. The straps 26 are engaged into the locking buckle 30 and the two ends of the strap 26 are pulled tight to extend the activation arms 32. This applies a tension to the strap 26 and activates the trip mechanism 34 within the display unit 24. When the proper initial tension has been applied to the attachment strap 26, each activation arm 32 will show a green indicator mark on the arm 32. Any excess length of the attachment strap 26 projecting from the buckle 30 can be cut-off. Installation is then complete.

As long as the security seal 20 remains under this initial tension, the display panel 28 remains, for example, white with black lettering. If the tension in the straps 26 is released, such as when the straps 26 of the seal 20 are cut off and discarded, the display panel 28 changes, for example, to a bright red color in, for example, approximately 2–4 hours, indicating an alert and that the seal 20 is void.

After installation on the locking bars 22 of the container, the visible security seal 20 is suspended between the two locking bars 22 of the container. The seal 20 is held under the initial load-tension by the springs 52 inside the display unit 24. The load- tension keeps the seal 20 activated or armed. This spring tension also prevents the visible security seal 20 from moving up or down along the locking bars 22.

The security seal 20 construction will withstand sporadic salt water/rain flowing over the seal 20; sixty (60) mile per hour wind velocity for, about 10 days; maximum 120° F. temperatures for one month and minimum −10° F. temperatures for one month; malfunctioning over at least 180 days activation life; and expansion or contraction due to climate variations that could reduce the initial applied tension.

Upon removal of the security seal 20 after use, the security seal 20 display panel 28 activates and changes to a red color, making it void. The seal 20 is disposable and even though it may be tampered with and opened after being discarded, it cannot be reconditioned to appear normal because the display panel 28 will be permanently colored bright red, thereby preventing further modification and use.

The shipping container can be the standard 20 foot or 40 foot lengths, or any variation thereof. The overall length of the display unit 24 is about 6 inches and the overall length including the attachment straps 26 is about 37 inches. The thickness of the display unit 24 is about ¾ inch. The display panel 28 is white with black numbering. The attachment straps 26 are transparent blue. The display panel 28 is visible from approximately 100 feet. The numbers on the panel are readable from a distance of 30 to 50 feet.

The seal's unique number 58 and bar code 60 are about 0.75 inch high in bar code format to permit reading by a scanner from at least 15 feet. After release of the initial tension, the red dye 36 contacts the white adhesive 38 and the color changing process begins. At room temperature (75° F.), the bright RED color appears in 2–4 hours. At colder temperatures (0° F.), the color may take 6–24 hours; at warmer temperatures (say 90° F.), the color may appear in 15 minutes.

Preferably, the enclosure/housing 40 is constructed of polystyrene (approx. 10 to 100 mils thickness); the attachment straps 26 are polyester (approximately 5–20 mils thick.); the display panel 28 is a "contact transparency material"; the activator arms 32 are made of a metal or a polymer; the one-way buckle 30 is styrene; the white adhesive 38 is a pressure sensitive adhesive; the alert dye 36 is Compton & Knowles 356 scarlet red or 218 orange; the security sleeve or bushing 48 is polystyrene; the spring 52 is metal; the actuated wedge 44 is polystyrene; the wedge contact point 50 is polystyrene; the hold-down plate/hold-down detents 62 are polystyrene; and the activator plate 42 is polystyrene.

Several methods may be used to attack the security seal 20 of this invention. However, the security seal 20 is constructed with elements arranged to provide countermeasures to these attacks.

For example, an attack can occur by attempting to physically prevent the red dye 36 from contacting the white adhesive 38 to indicate an alert. This can be done, for example, by cutting and/or removing the elements of the display panel 28, or cutting the display panel 28 and inserting a barrier, such as a piece of cardboard, between the display panel 28 and the activator plate 42. Such an attack is resisted by the housing unit's 40 sealed, one-piece enclosure, molded from brittle plastic. The housing 40 will be difficult to cut, drill, or break without showing visible signs of the attack. Any holes, marks, screws, or fractures should be clearly visible from the front. The plastic used to construct the housing 40 will be a color other than white or black, making it difficult to exactly match the color of the enclosure.

An attack can also be attempted by spraying a water based aerosol such as shaving cream, foam, or shoe polish into the housing 40 to prevent the red dye 36 on the activator plate 44 from touching the white adhesive 38 on the display panel 28. This will not meet with success because the water based aerosol dissolves the red dye 36 causing it to rapidly bleed through the white adhesive coating 38 on the display panel 28. Within a few minutes, the dye 36 will be visible on the panel 28. Alternatively, spraying a solvent based aerosol such as paint, glue, or hair spray into the unit 24 will also dissolve the red dye 36 and cause it to bleed.

If, for example the activation arms 32 are retained in an attempt to prevent them from retracting into the housing 40, for example by pliers, inserting pins through the arms 32, etc., each activation arm 32 is enclosed by a security sleeve or bushing 48 that protrudes about ¾ inch from the unit 24. The bushing 48 is free floating and when the tension on the arm 32 is released, the sleeve 48 will retract.

Alternatively, if a clamp or drill is used on the bushing 48 to prevent it from retracting into the unit 24 when the tension on the straps is removed, the bushing 48 is made of brittle plastic that will fracture when clamped or drill. These broken or fractured sleeves will be readily visible to an observer.

If an attempt is made to drill or cut into the back of the unit 24, it is difficult to reach because of the spring tension of the attachment strap 26. However, if additional countermeasures become necessary, a metal plate can be attached to cover the back of the display unit 24.

If an attempt is made to use counterfeit numbers or to cover the display panel 28 by applying labels or painting the display panel 28, conventional anti-counterfeiting measure may be used such as applying a small hologram on the display panel 28.

If an attempt is made to reconstruct or reuse the elements of the display unit 24, the dye 36 will bleed into the plastic so that it cannot be reused. As an added alert indicia, a security pattern, such as diagonal bars can be displayed with the red/orange dye color.

Figure 12:
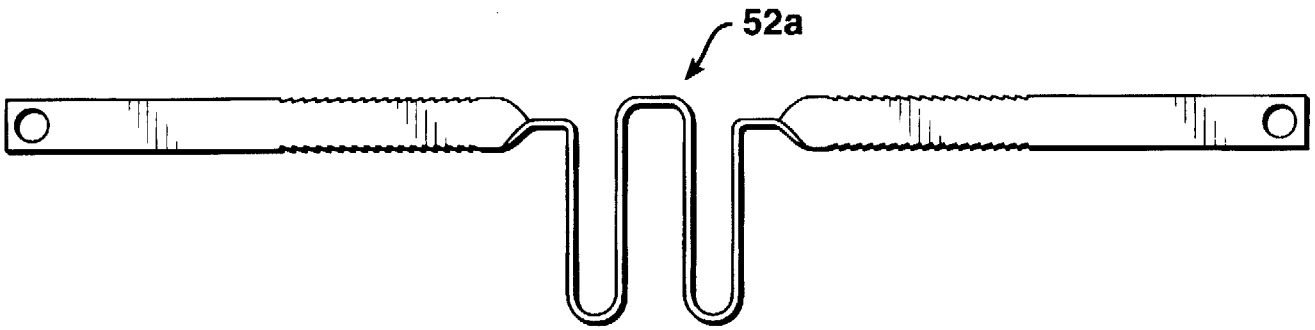
FIGS. 12–14 show another embodiment of the visible security seal of this invention.
Figure 13:
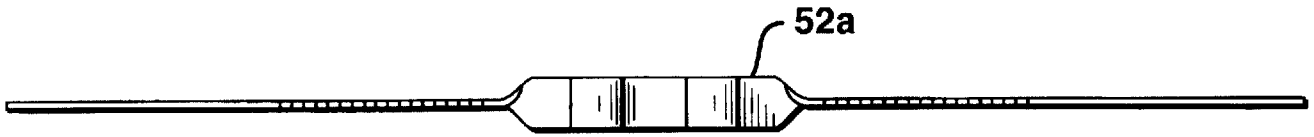
Figure 14:
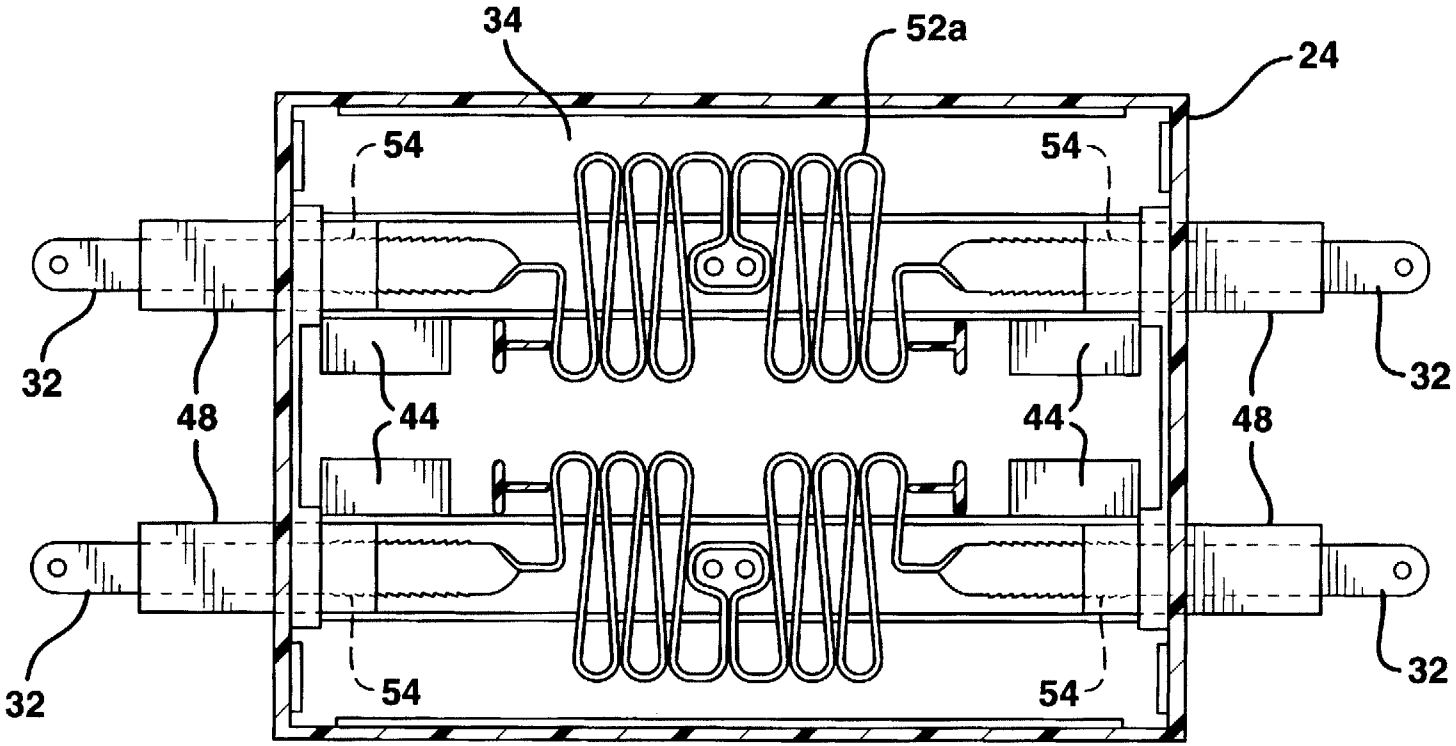

FIGS. 12–14 show another embodiment of the security seal 20 of this invention. In this embodiment of the seal 20, the coil spring 52 is replaced with a flat spring **52*a* to arm the seal 20. In particular, the flat spring 52*a* can be used to replace coil spring 52 and activator arm 32. The flat spring 52*a*** would, however, still be constructed of metal and have the 15 lb. tensile force.

FIG. 14 shows the arrangement of the flat spring **52*a* employed between two opposing activator arms 32 and in bushings 48**.

Figure 16:
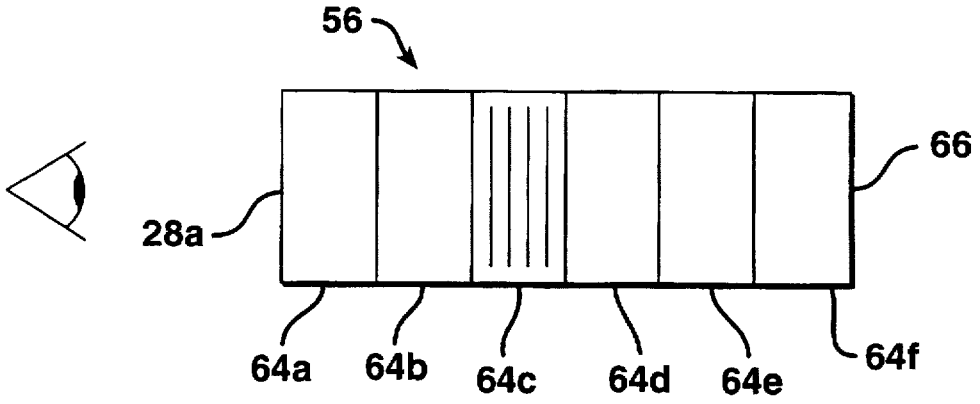
FIG. 16 is a schematic view of the embodiment of FIG. 15.

FIGS. 15 and 16 show another embodiment of the security seal 20 of to this invention. In this embodiment, a flexible plastic pouch 56 is employed as the display unit 24 instead of the rigid plastic enclosure.

The security seal 20 shown in FIGS. 15 and 16, prior to installation and activation, is packaged as a flat strip in a plastic bag relatively impervious to salt water conditions and other extremes of environment. The seal 20 consists of a display area **28*a* for displaying identifying indicia such as a security number, bar code, an attachment strap 26, and a plastic latching buckle 30. The pouch 56 encloses a plurality of laminates 64*a–f* which are separated when under tension to activate or "arm" the seal 20. When the tension in the seal 20 is relaxed, such as when someone tampers with or enters the container, the seal 20 provides the visual/alert display. The security seal 20 of FIG. 15 is mounted to the locking bars 22 of the container in a manner similar to the security seal 20 shown in FIG. 5**.

Referring to FIG. 16, when viewed from the front **28*a*, i.e. viewing the seal 20 from the exterior of the shipping container, the first or outermost laminate 64*a* is a clear plastic layer having an exterior surface exposed to the air and an underlying surface to which a white adhesive layer 64*b* is disposed. The white adhesive layer 64*b* overlays strips of specially formulated paper 64*c* having a chemical substance thereon. The paper strips 64*c* are attached to a dye sheet 64*d* that contains an adhesive 64*e* on the plastic sheet panel 64*f* at the back of the pouch 56**.

Prior to mounting the seal 20 to the locking bars 22 of the container, the laminates 64 are compressed so that the strips of the specially formulated paper 64*c* are attached by their respective ends to the front panel 28*a* and back panel 66 of the pouch 56. When the end of the strap 26 is passed through the buckle 30 and cinched through the buckle 30 to apply the initial tension to the strap 26, the front 28*a* and back panels 66 are pulled apart and an air gap is provided between the papers. This is the actuation stage and results in the dye 64*d* being exposed to face the white adhesive layer 64*b*. If the tension on the strap 26 is released, for example, by tampering with the strap 26 or the container locking bars 22, the front 28*a* and back panels 66 move into engagement with each other causing the dye 64*d* to contact the white adhesive 64*b* and bleed there through so that the dye is viewable through the clear plastic sheet of the display panel 28.

A preferred embodiment of the seal 20 is shown in FIGS. 15 and 16 and includes a 6 by 6 inch display panel 28*a* with tension straps 26 extending from each side thereof to wrap around the pair of locking bars 22 of the shipping container. The overall length of the seal 20 is approximately 30 inches. The thickness of the pouch 56 is approximately ¼ inch before activation, and 1.5 inches when activated. The display panel 28*a* has a unique identification number at least 1 inch high and ½ inch wide. A bar code can be printed thereon with letters 0.75 inches high to permit reading by a scanner from at least 15 feet.

It is understood that the embodiments described herein are merely exemplary and that a person skilled in the art may make many variations and modifications without departing from the spirit and scope of the invention. All such modifications and variations are intended to be included within the scope of this invention.

What is claimed is:

1. A seal for a container comprising:

a strap means mountable to locking bars of the container;

a tensioning means connected to the strap means for applying tension to the strap means after the strap means are mounted to the locking bars; and an indicator means affixed to the strap means, the indicator means having:

a first indicia means coacting with the strap means for indicating that the strap means is at an initial tension and the container is secured, and a second indicia means also coacting with the strap means for indicating that the strap means is at a second tension less than the initial tension after the initial tension has been applied, wherein the first indicia means indicates that the strap means is securely mounted to the locking bars and the second indicia means indicates that the strap means is not securely mounted to the locking bars thus indicating that there may have been tampering with the seal.

2. The seal of claim 1, wherein the first indicia means is a first color display and the second indicia means is a second color display.

3. The seal of claim 2, wherein the indicator means includes parallel first and second surfaces maintained in a spaced apart relationship to each other when the strap means is maintained at the initial tension, wherein one of the surfaces is the first color display, and when the strap means is at the second tension the surfaces are maintained in contact with each other to convert the surface with the first color display into the second color display.

4. The seal of claim 3, wherein one of the surfaces is coated with an adhesive to produce the first color display and other surface is coated with a dye, and when the surfaces are in contact with each other the dye converts the adhesive from the first color display to the second color display and the adhesive assist in maintaining the surfaces in contact with each other at the second tension.

* * * * *